US006555956B1

(12) United States Patent
Kim

(10) Patent No.: US 6,555,956 B1
(45) Date of Patent: Apr. 29, 2003

(54) METHOD FOR FORMING ELECTRODE IN PLASMA DISPLAY PANEL AND STRUCTURE THEREOF

(75) Inventor: Jeong Jun Kim, Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/260,090

(22) Filed: Mar. 2, 1999

(30) Foreign Application Priority Data

Mar. 4, 1998 (KR) ..... 98-7146
Jan. 14, 1999 (KR) ..... 99-868

(51) Int. Cl.[7] ..... H01J 17/49; H01J 19/28; H01J 19/30

(52) U.S. Cl. ..... 313/491; 313/583; 313/582

(58) Field of Search ..... 313/582, 583, 313/584, 585, 586, 587, 484, 491, 311, 489, 39; 445/24

(56) References Cited

U.S. PATENT DOCUMENTS 5,242,544 A * 9/1993 Itoh et al. ..... 216/49
5,838,106 A * 11/1998 Funada ..... 313/112
5,900,694 A * 5/1999 Matsuzaki et al. ..... 313/484
5,999,155 A * 12/1999 Satou ..... 345/93
6,004,471 A * 12/1999 Chuang ..... 216/16
6,160,345 A * 12/2000 Tanaka et al. ..... 313/489
6,162,107 A * 12/2000 Woo ..... 445/24
6,242,859 B1 * 6/2001 Betsui et al. ..... 313/584
6,346,772 B1 * 2/2002 Nishiki et al. ..... 216/102

FOREIGN PATENT DOCUMENTS

| | | |
|---|---|---|
| JP | 4877760 | 10/1973 |
| JP | 4942437 | 11/1974 |
| JP | 54116106 | 9/1979 |
| JP | 54121665 | 9/1979 |
| JP | 5895382 | 6/1983 |
| JP | 1122549 | 5/1989 |
| JP | 08222128 | 8/1996 |
| JP | 08227656 | 9/1996 |
| JP | 10021837 | 1/1998 |

* cited by examiner

*Primary Examiner*—Nimeshkumar D. Patel
*Assistant Examiner*—Karabi Guharay
(74) *Attorney, Agent, or Firm*—Fleshner & Kim, LLP

(57) ABSTRACT

A method for forming an electrode in a plasma display panel, which simplify fabrication steps of a metal electrode and a transparent electrode and prevent bubbles from being generated due to reaction between the metal electrode and a dielectric layer, includes the steps of forming a metal oxide layer on a transparent substrate in a predetermined pattern, etching a surface of the metal oxide layer to form an uneven portion, and chemical plating a surface of the uneven portion to form a metal electrode.

25 Claims, 7 Drawing Sheets

METHOD FOR FORMING ELECTRODE IN PLASMA DISPLAY PANEL AND STRUCTURE THEREOF

BACKGROUND OF THE INVENTION

1. Field of the Invention

The present invention relates to a plasma display panel, and more particularly, to a method for forming an electrode in a plasma display panel and a structure thereof.

2. Background of the Related Art

Generally, a plasma display panel of three-electrode area discharge type is formed in such a manner that an upper substrate 10 and a lower substrate are opposite to each other so as to be adhered to each other, as shown in FIG. 1*a*. FIG. 1*b* shows a sectional structure of the plasma display panel of FIG. 1*a*, in which the lower substrate 20 is rotated by 90°.

The upper substrate 10 includes a sustain electrode, a dielectric layer 11 deposited on the sustain electrode, and a passivation layer 12 deposited on the dielectric layer 11. The lower substrate 20 includes an address electrode 22, an isolation wall 23 formed between the respective address electrodes 22, a lower dielectric layer 21 deposited on the address electrode 22, and a phosphor 24 formed on the lower dielectric layer 21. An inert gas is introduced into a space between the upper substrate 10 and the lower substrate 20, and such a space serves as a discharge area.

In order to increase light transmittivity of a discharge cell, as shown in FIGS. 2*a* and 2*b*, the sustain electrode includes a transparent electrode 16 and a metal electrode 17. FIG. 2*a* is a plane view of the sustain electrode, and FIG. 2*b* is a sectional view of the sustain electrode. A discharge voltage from a driving integrated circuit (IC) which is mounted outside is applied to the metal electrode 17. The discharge voltage applied to the metal electrode 17 is transmitted to the transparent electrode 16. Thus, discharge occurs between adjacent transparent electrodes 16.

The sustain electrode has a width of about 300 $\mu$m. The transparent electrode 16 is made of indium oxide or tin oxide, and the metal electrode 17 is made of a three-layered thin film of Cr—Cu—Cr. The metal electrode has a line width in the range of one third of the transparent electrode. The transparent electrode 16 has high resistance and is opaque, so that high transmittivity and low resistance can be maintained at a certain level.

The sustain electrode consisting of the transparent electrode 16 and the metal electrode 17 has a sectional structure that the metal electrode 17 is formed on the transparent electrode 16 as shown in FIG. 3.

A method for forming the sustain electrode shown in FIG. 3 will be described with reference to FIGS. 4*a* and 4*b*.

As shown in FIG. 4*a*, the transparent electrode 16 is formed on the transparent substrate 10. The transparent electrode 16 has excellent adhesive property to glass while the metal electrode 17 has poor adhesive property to glass. Therefore, in a related art method for fabricating a plasma display panel, the transparent electrode 16 is deposited on glass.

Thereafter, as shown in FIG. 4*b*, Cr, Cu and Cr are deposited on the transparent electrode 16 and then patterned to form the metal electrode 17. The three-layered metal electrode 17 is formed by sputtering process under the vacuum. Cu has low resistance but is not likely to be deposited on the transparent electrode. On the other hand, Cr is likely to be deposited on the transparent electrode. In this respect, Cr is deposited on the transparent electrode and then Cu is deposited on Cr. Also, since Cu is easily oxidized if it is exposed outside, a separate passivation layer is required. For passivation of Cu, Cr is again deposited on Cu.

If the dielectric layer 11 and the passivation layer 12 are deposited on the transparent electrode 16 and the three-layered metal electrode, the sustain electrode is completed on the upper substrate 10 of the plasma display panel as shown in FIG. 3.

The related art sustain electrode has several problems.

Since the related art sustain electrode is formed by vacuum process such as sputtering, fabrication cost is high and the process steps become complicated. Also, bubbles occur in the dielectric layer 11 by reaction with the metal electrode 17 (particularly, Cu), thereby destroying insulating state and causing unstable operation of the plasma display panel. Moreover, in view of the fact that the three-layered metal electrode 17 of Cr—Cu—Cr is formed on the transparent electrode 16, if Cu is thickly formed to lower resistance, step coverage is deteriorated.

SUMMARY OF THE INVENTION

Accordingly, the present invention is directed to a method for forming an electrode in a plasma display panel and a structure thereof that substantially obviate one or more of the problems due to limitations and disadvantages of the related art.

An object of the present invention is to provide a method for forming an electrode in a plasma display panel and a structure thereof, which improve adhesive property of a metal electrode by forming a metal oxide layer on a glass substrate and chemical plating the metal electrode on the metal oxide layer, and reduce the fabrication cost.

Other object of the present invention is to provide a method for forming an electrode in a plasma display panel and a structure thereof, which simplify fabrication steps of a metal electrode and a transparent electrode and prevent bubbles from being generated due to reaction between the metal electrode and a dielectric layer, so as to form a plasma display panel of which operation is stable.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method for a sustain electrode of a plasma display panel according to the present invention includes the steps of forming a metal oxide layer on a transparent substrate in a predetermined pattern, etching a surface of the metal oxide layer to form an uneven portion, and chemical plating a surface of the uneven portion to form a metal electrode.

In another aspect, a sustain electrode of a plasma display panel according to the present invention includes a metal oxide layer formed on a transparent substrate, a metal electrode formed on the metal oxide layer in the same pattern, and a transparent electrode formed on the transparent substrate to be deposited on the metal electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A method for forming a sustain electrode according to the present invention will be described with reference to FIGS. 5*a* to 5*c*.

Figure 1A:
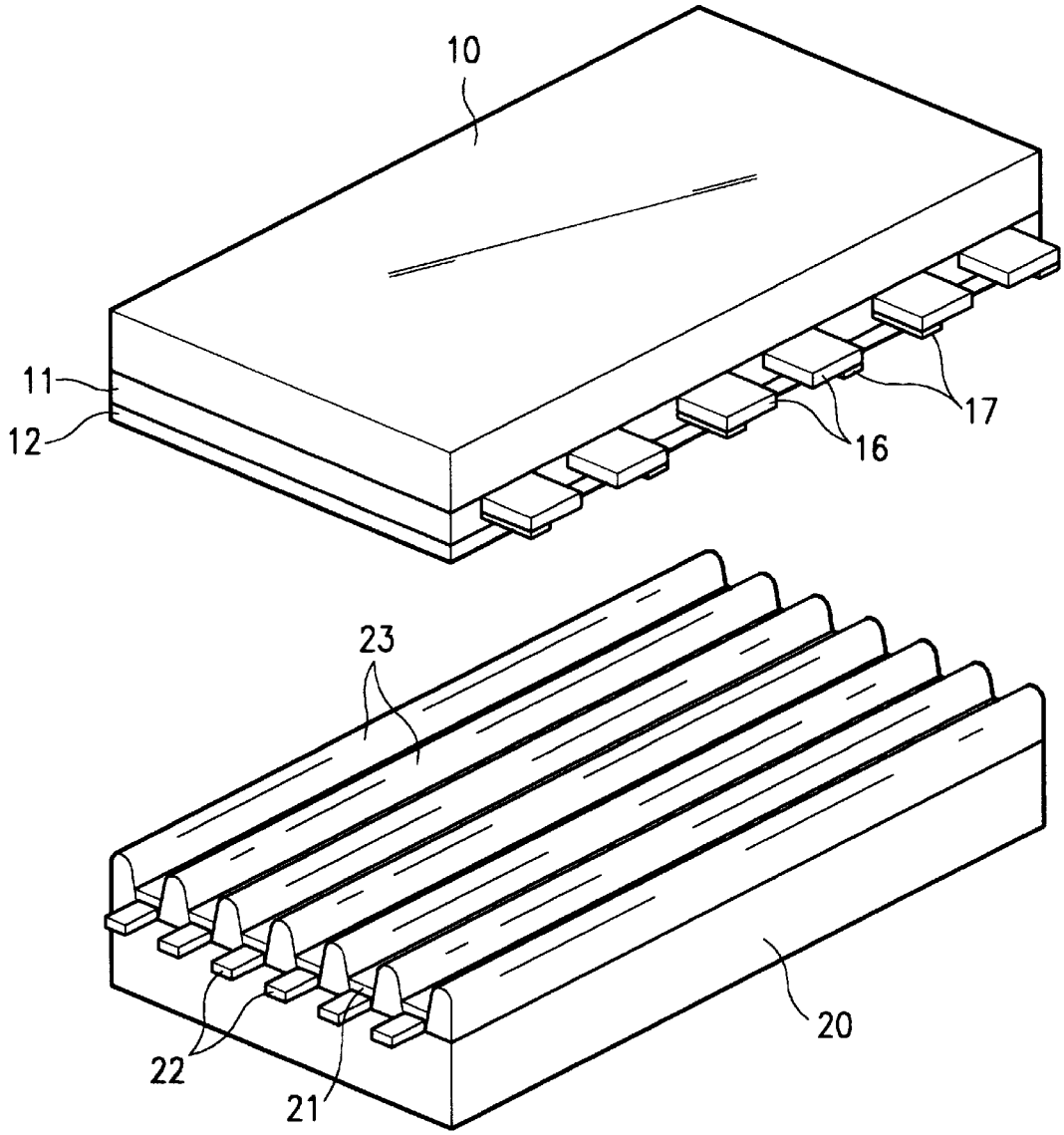
FIG.1A Background Art
FIG. 1*a* is a perspective view illustrating an upper substrate and a lower substrate in a related art plasma display panel.
Figure 1B:
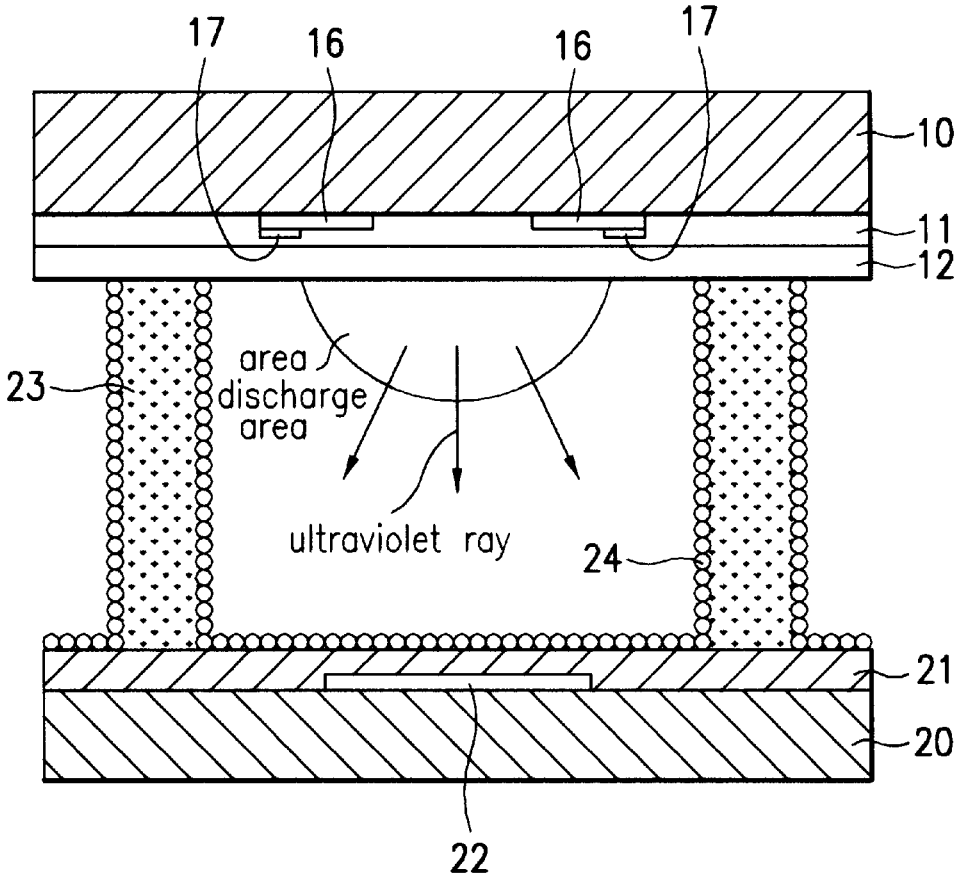
FIG.1B Background Art
FIG. 1*b* is a sectional view illustrating an upper substrate and a lower substrate in a related art plasma display panel.
Figure 2A:
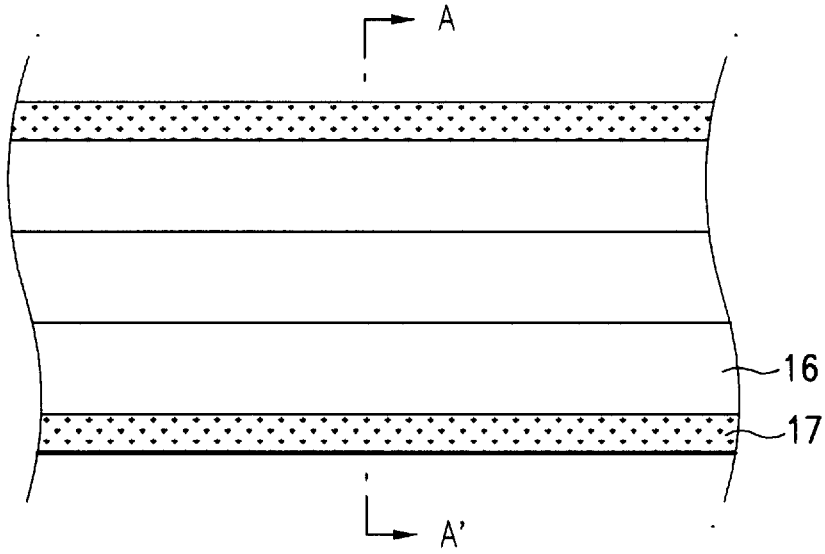
FIG.2A Background Art
FIG. 2*a* is a plane view illustrating a structure of a sustain electrode arranged in a related art display panel.
Figure 2B:
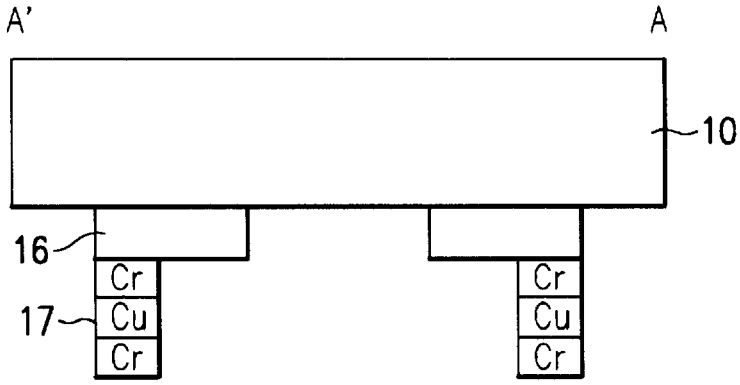
FIG.2B Background Art
FIG. 2*b* is a sectional view illustrating a structure of a sustain electrode arranged in a related art display panel.
Figure 3:
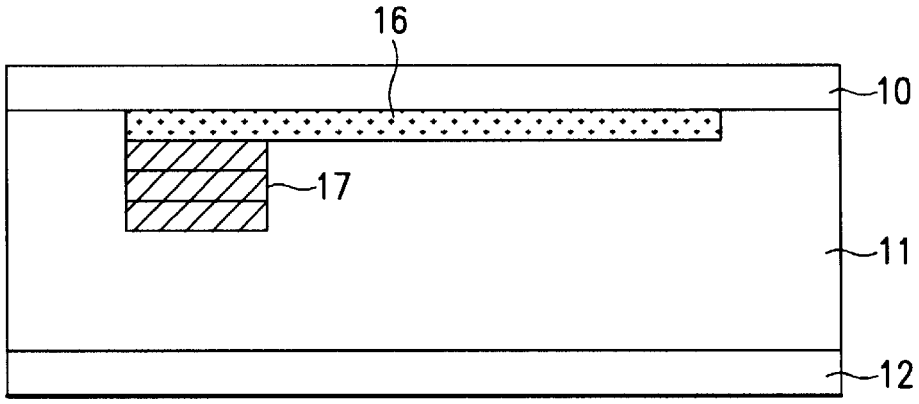
FIG.3 Background Art
FIG. 3 is a sectional view illustrating a structure of a sustain electrode arranged in a related art display panel.
Figure 4A:
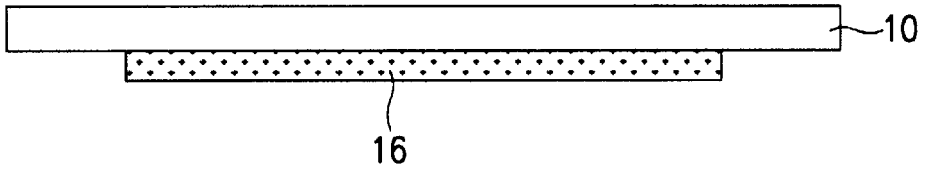
FIG.4A Background Art
FIGS. 4*a* and 4*b* are sectional views illustrating a method for fabricating a related art plasma display panel in which a sustain electrode is formed.
Figure 4B:
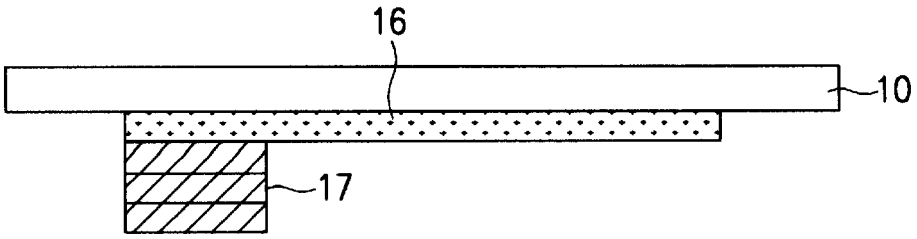
FIG.4B Background Art
Figure 5A:
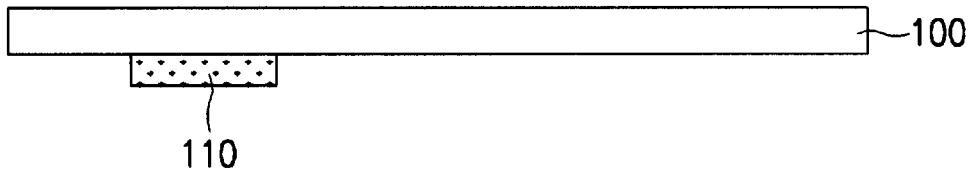
FIGS. 5*a* to 5*c* are sectional views illustrating a method for forming a sustain electrode according to the present invention.
Figure 5B:
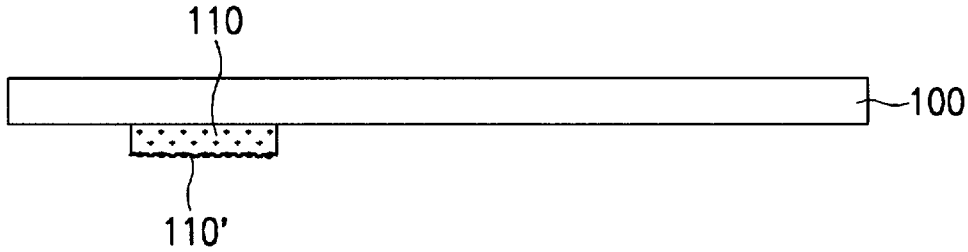
Figure 5C:
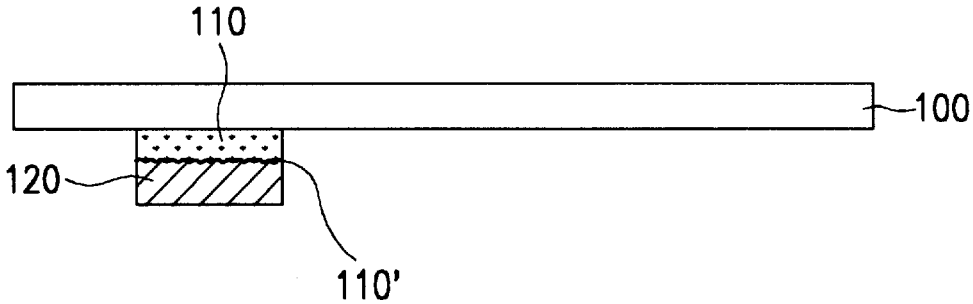

As shown in FIG. 5*a*, a metal oxide layer 110 is formed on a transparent substrate 100. In more detail, a metal oxide such as zinc oxide or titanium oxide is deposited on an entire surface of the transparent substrate 100 by spray thermal decomposition and then patterned in a predetermined pattern. A method for patterning the metal oxide layer 110 includes the steps of depositing a photoresist (not shown) on the metal oxide layer 110, patterning the photoresist in a predetermined pattern, and patterning the metal oxide layer 110 in a photoresist pattern.

The transparent substrate 100 in which the metal oxide layer 110 is formed is exposed in acid solution such as $PbCl_2$. Then, as shown in FIG. 5*b*, a surface of the metal oxide layer 110 is finely etched by the acid solution and then catalyzed to facilitate chemical plating.

Thereafter, the transparent substrate 100 in which the catalyzed metal oxide layer 110 is formed is exposed in a chemical plating solution compounded of $CuSO_4$ solution to perform chemical plating. As a result of such a chemical plating, as shown in FIG. 5*c*, a metal layer is plated on the surface 110' of the catalyzed metal oxide layer to form a metal electrode 120 of the present invention. Subsequently, a dielectric layer 140 and a passivation layer 150 are formed on the metal electrode 120, so that the formation of an electrode of a plasma display panel according to the present invention is completed.

The structure of the sustain electrode of the plasma display panel according to the present invention and the method for forming the sustain electrode thereof will be described below.

First Embodiment

Figure 7:
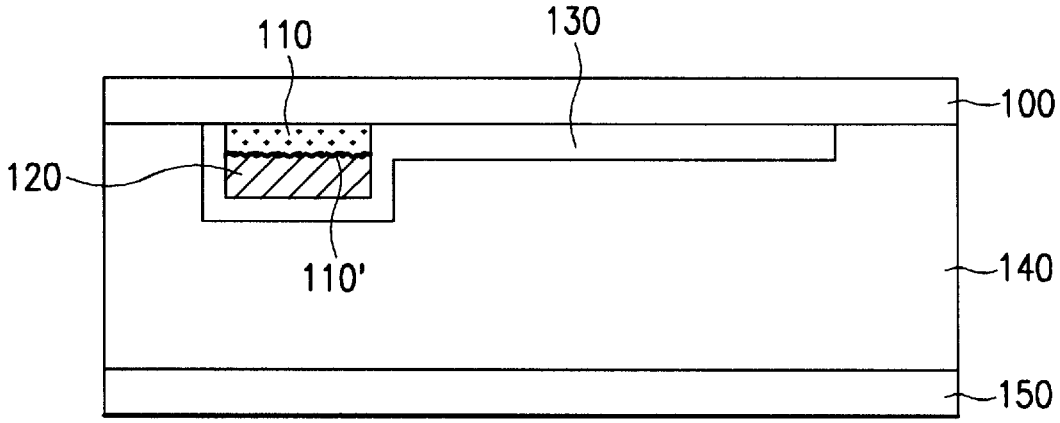
FIG. 7 is a sectional view illustrating a sustain electrode according to the first embodiment of the present invention.

In the first embodiment of the plasma display panel according to the present invention, as shown in FIG. 7, the sustain electrode includes a metal oxide layer 110 formed on a transparent substrate 100, a metal electrode formed on the metal oxide layer 110, and a transparent electrode 130 formed on the transparent substrate 100 to be deposited on the metal electrode.

The metal oxide layer 110 made of zinc oxide or titanium oxide is formed on the transparent substrate 100. The surface of the metal oxide layer 110 is etched by acid solution such as $PbCl_2$ to form an uneven portion 110'. In the uneven portion 110' of the metal oxide layer 110, the metal electrode is formed later. The metal electrode has the same pattern as the metal oxide layer 110. The metal electrode is preferably formed of low resistance metal such as Cu in the same pattern as the metal oxide layer 110. The transparent substrate 100 and Cu have low adhesive property therebetween. However, the uneven portion of the metal oxide layer 110 is more excellent than the transparent substrate 100 in adhesive property to Cu. Accordingly, in the first embodiment, since the metal oxide layer 110 is used as an adhesive medium between Cu and the transparent substrate 100, the metal electrode made of Cu is adhered to the transparent substrate 100.

Second Embodiment

Figure 6A:
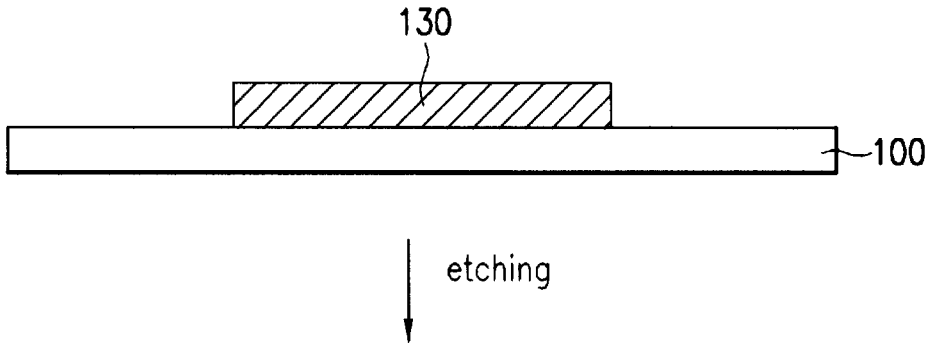
FIGS. 6*a* to 6*c* are sectional views illustrating a method for forming a metal electrode of a sustain electrode according to the present invention.
Figure 6B:
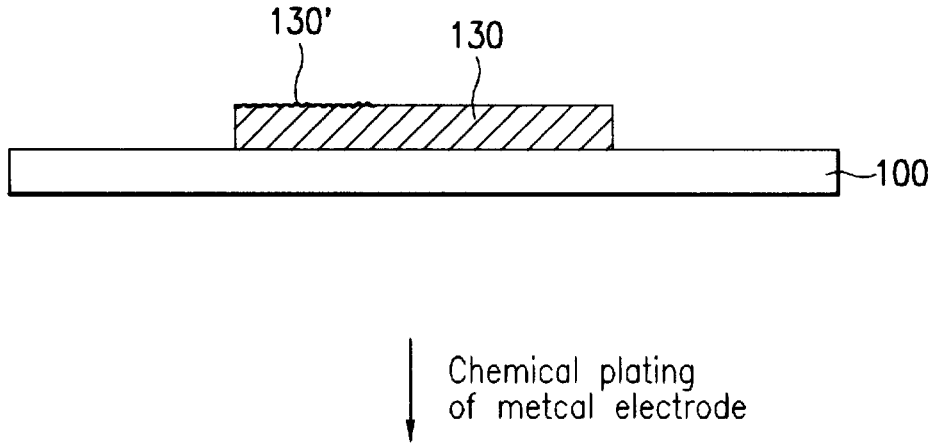
Figure 6C:
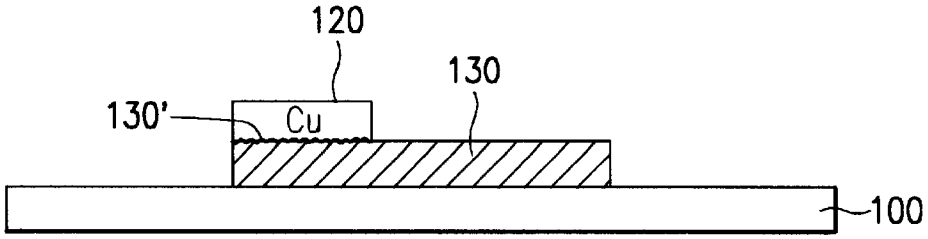

In the second embodiment of the present invention, the method for forming the sustain electrode includes the steps of depositing a transparent electrode on a substrate as shown in FIG. 6*a*, finely etching some surface of the transparent electrode 130 as shown in FIG. 6*b*, and forming a metal electrode. 120 on the etched surface of the transparent electrode 130. At this time, the method for forming the metal electrode 120 includes the steps of chemical plating the surface of the transparent electrode 130 with Cu, in which the uneven portion is formed, to form a first metal electrode layer, so as to form a first metal electrode, and chemical plating the first metal electrode layer with Cr so as to form a second metal electrode layer. In this embodiment, the metal electrode 120 is formed with two layers because Cu is easily oxidized in the air and can generate bubbles by reaction with the dielectric layer 140. To prevent bubbles from being generated due to reaction between the metal electrode 120 and the dielectric layer 140, Cu is deposited on the surface of the transparent electrode and then Cr is deposited on Cu.

Figure 8:
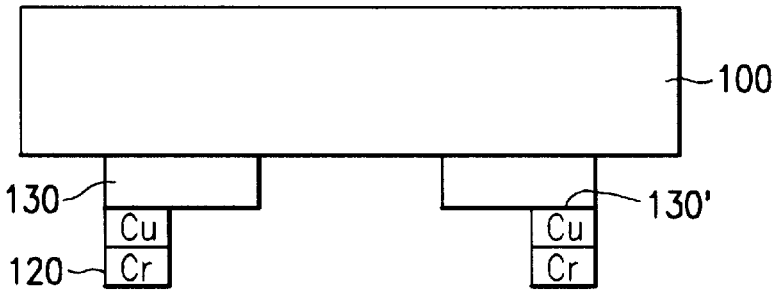
FIG. 8 is a sectional view illustrating a sustain electrode according to the second embodiment of the present invention.

In the second embodiment of the plasma display panel according to the present invention, as shown in FIG. 8, the sustain electrode includes a transparent electrode 130 formed on the transparent substrate 100, a first metal electrode formed on the transparent electrode 130, and a second metal electrode formed on the first metal electrode to be deposited on the second metal electrode.

The transparent electrode 130 is formed on the transparent substrate 100 in a predetermined pattern and a fine uneven portion 130' is partially formed in the transparent electrode 130. The uneven portion 130' is formed in such a manner that the surface of the transparent electrode 130 is etched by acid solution.

The first metal electrode is formed in the uneven portion 130' of the transparent electrode 130. The first metal electrode is made of Cu. Since Cu originally has low adhesive property to the transparent electrode 130, it is difficult to deposit Cu on she transparent electrode 130 by a conventional deposition method.

In the present invention, since a fine uneven portion is formed in some of the transparent electrode 130, this uneven portion serves as catalyst which deposits Cu. The sustain electrode of the present invention is formed in such a manner that Cu is deposited on the uneven portion 130' of the transparent electrode 130.

The second metal electrode is deposited on the first metal electrode. The second metal electrode is made of Cr to prevent the first metal electrode made of Cu from being oxidized. Cu is easily oxidized in the air and generates bubbles by reaction with the dielectric layer 140. This is likely to deteriorate performance of the plasma display panel. Therefore, it is preferable that the second metal electrode made of metal such as Cr is deposited on the first metal electrode made of Cu.

The method for forming the sustain electrode in the plasma display panel and the structure thereof according to the present invention is applicable to a method for forming a different electrode on a substrate and the structure thereof, and has the following advantages.

Since the metal electrode 120 according to the first and second embodiments of the present invention is formed to be separated from the dielectric layer 140, bubbles are not generated by reaction between the dielectric layer 140 and the metal electrode 120. Also, adhesive property of the metal electrode 120 is increased by the uneven portion of the metal oxide 110 or the transparent electrode 130. The metal material in the uneven portions 110' and 130' serves to break leakage light from a discharge cell. Therefore, the sustain electrode of the present invention improves quality of the plasma display panel as compared with the related art sustain electrode, and fabricates the plasma display panel of which operation is stable.

It will be apparent to those skilled in the art that various modifications and variations can be made in the method for forming an electrode in a plasma display panel and a structure thereof according to the present invention without departing from the spirit or scope of the invention. Thus, it is intended that the present invention covers the modifications and variations of the invention provided they come within the scope of the appended claims and their equivalents.

What is claimed is:

1. A structure of an electrode in a plasma display panel, comprising:

a metal oxide layer comprising titanium oxide or zinc oxide formed on a transparent substrate;

a metal electrode formed directly on a lower surface of the metal oxide layer in the same pattern; and a transparent electrode formed on the transparent substrate and the metal electrode.

2. The structure of an electrode in a plasma display panel as claimed in claim 1, wherein the lower surface of the metal oxide layer is uneven.

3. The structure of an electrode in a plasma display panel as claimed in claim 2, wherein the metal electrode comprises Cu and wherein the metal electrode is adhered directly to the uneven lower surface of the metal oxide.

4. The structure of an electrode in a plasma display panel as claimed in claim 1, wherein the metal electrode comprises Cu.

5. The structure of an electrode in a plasma display panel as claimed in claim 1, wherein the metal oxide layer and the metal electrode are formed under an outer, off-centered portion of the transparent electrode.

6. The structure of an electrode in a plasma display panel as claimed in claim 1, wherein the lower surface of the metal oxide layer is etched and then catalyzed to facilitate chemical plating.

7. The structure of an electrode in a plasma display panel as claimed in claim 1, wherein the metal electrode comprises a single metal layer.

8. The structure of an electrode in a plasma display panel as claimed in claim 1, wherein the metal electrode comprises a metal that is different from the metal in the metal oxide.

9. A structure of an electrode in a plasma display panel, comprising:

a transparent electrode formed on a transparent substrate;

a first metal electrode comprising Cu is formed directly on a portion of a lower surface of the transparent electrode, wherein the portion of the lower surface of the transparent electrode that contacts the first metal electrode has an uneven surface and the portion of the first metal electrode on the uneven surface serves to break leakage light from a discharge cell of the plasma display panel; and a second metal electrode comprising Cr formed directly on the first metal electrode.

10. The structure of an electrode in a plasma display panel as claimed in claim 9, wherein the first metal electrode is formed directly on the uneven surface and an outer edge of the transparent electrode is aligned with an outer edge of the first metal electrode.

11. The structure of an electrode in a plasma display panel as claimed in claim 9, wherein the second metal electrode prevents oxidation of the first metal electrode.

12. The structure of an electrode in a plasma display panel as claimed in claim 9, wherein the first metal electrode is formed along an outer, off-centered portion of the transparent electrode.

13. The structure of an electrode in a plasma display panel as claimed in claim 9, wherein the uneven surface is formed by etching.

14. A structure for a plasma display panel, comprising:

an upper substrate;

a metal oxide comprising zinc oxide or titanium oxide formed on the upper substrate;

a metal electrode formed on a lower surface of the metal oxide;

a transparent electrode formed on the upper substrate and the metal electrode;

a lower substrate facing the upper substrate;

an address electrode formed on the lower substrate; and a plurality of isolation walls extending from the lower substrate.

15. The structure for a plasma display panel as claimed in claim 14, wherein the lower surface of the metal oxide is uneven.

16. The structure of an electrode in a plasma display panel as claimed in claim 15, wherein the lower surface of the metal oxide is etched and then catalyzed to facilitate chemical plating.

17. The structure for a plasma display panel as claimed in claim 14, wherein the metal electrode comprises a single metal layer.

18. The structure for a plasma display panel as claimed in claim 15, wherein the metal electrode comprises Cu and wherein the metal electrode is adhered directly to the uneven lower surface of the metal oxide.

19. The structure for a plasma display panel as claimed in claim 14, wherein the metal electrode comprises Cu.

20. The structure of an electrode in a plasma display panel as claimed in claim 14, wherein the metal oxide layer and the metal electrode are formed under an outer, off-centered portion of the transparent electrode.

21. A structure for a plasma display panel, comprising:

an upper substrate;

a transparent electrode formed on the upper substrate;

a first metal electrode comprising Cu formed directly on a portion of a lower surface of the transparent electrode, wherein the portion of the lower surface of the transparent electrode that contacts the first metal electrode has an uneven surface and the portion of the first metal electrode on the uneven surface serves to break leakage light from a discharge cell of the plasma display panel;

a second metal electrode comprising Cr formed directly on the first metal electrode;

a lower substrate facing the upper substrate;

an address electrode formed on the lower substrate; and a plurality of isolation walls extending from the lower substrate.

22. The structure for a plasma display panel as claimed in claim 21, wherein the first metal electrode is formed directly on the uneven surface and an outer edge of the transparent electrode is aligned with an outer edge of the first metal electrode.

23. The structure of an electrode in a plasma display panel as claimed in claim 21, wherein the uneven surface is formed by etching.

24. The structure of an electrode in a plasma display panel as claimed in claim 21, wherein the first metal electrode is formed along an outer, off-centered portion of the transparent electrode.

25. The structure for a plasma display panel as claimed in claim 21, wherein the second metal electrode prevents oxidation of the first metal electrode.

* * * * *